United States Patent [19]

Milan et al.

[11] 4,058,057

[45] Nov. 15, 1977

[54] MOISTURE METERING CONTROL APPARATUS

[75] Inventors: Otto G. Milan, Schaumburg; Edward J. Klich, Chicago, both of Ill.

[73] Assignee: Addressograph-Multigraph Corporation, Cleveland, Ohio

[21] Appl. No.: 775,909

[22] Filed: Mar. 9, 1977

[51] Int. Cl.[2] ..... B41F 7/40; B41L 25/16

[52] U.S. Cl. ..... 101/148; 101/349; 101/DIG. 6

[58] Field of Search ..... 101/349, 350, 351, 352, 101/357, 358, 361, 362, 206, 207, 208, 209, 148, DIG. 6; 192/12 B

[56] References Cited

U.S. PATENT DOCUMENTS

| | | | |
|---|---|---|---|
| 1,985,406 | 12/1934 | Galkin | 192/12 B |
| 2,693,755 | 11/1954 | Fitchett et al. | 101/350 |
| 2,728,292 | 12/1955 | Harless | 101/363 |
| 2,821,911 | 2/1958 | Mestre | 101/148 X |
| 2,950,677 | 8/1960 | Staley | 101/350 |
| 2,990,770 | 7/1961 | Lindemann | 101/350 X |

*Primary Examiner*—J. Reed Fisher

*Attorney, Agent, or Firm*—Russell L. Root

[57] ABSTRACT

A moisture system control apparatus is provided for metering the rate of feed of dampening fluid from a fountain apparatus including a fountain roller to a master on a master cylinder of a lithographic duplicating machine. The control apparatus comprises a linkage for converting continuous rotary input motion to incremental rotation of the fountain roller, and infinitely variable selector apparatus for adjusting the magnitude of the rotation increments employed during a first mode of operation which obtains while printing is in progress. Trip apparatus is provided for establishing a second mode of operation, in response to non-feeding of a copy sheet, in which the magnitude of the incremental rotations of the fountain roller are reduced from that obtaining during the first mode of operation to maintain the rate of feed of the dampening fluid at a low level while the machine is idling and copy sheets are not being duplicated, and for restoring the operation of the control apparatus from the second mode of operation to the first in response to a copy sheet being fed and the printing operation resumed.

8 Claims, 5 Drawing Figures

INCREASE

MOISTURE METERING CONTROL APPARATUS

BACKGROUND OF THE INVENTION

In a lithographic duplicating process, an image to be reproduced is placed on a lithographic master and the master is attached to a master cylinder of the duplicating machine. The image on the master attracts the grease-base ink and repels water, while the non-image or background portions of the master attract water and repel ink.

With each revolution of the master cylinder, the film of water or dampening fluid and the film of ink are replenished on the surface of the master on the cylinder. The water allows the ink film to adhere only to the image areas of the master that are to be reproduced. Thereafter, the film of ink is transferred from the image on the master to a blanket on a blanket cylinder and from there to a copy sheet as it passes between the blanket and impression cylinders.

Because of variable factors such as humidity, temperature, the type of master and copy paper being used, etc., all of which have an influence on the quality of the copy reproduced and to a great extent determine the amount of water or dampening fluid that should be supplied to the master, control and metering of the water is critical in the production of high quality duplicated copies.

There are many known devices for controlling the rate of feed of dampening fluid in offset duplicating machines, and it is customarily found convenient to effect this control by means of an adjustable drive for incremental rotation of the fountain roller by selected increments. The fountain roller conveys the fluid to a roller of a moisture roller train which transfers the fluid via other rollers in the train to the master on the master cylinder of the machine.

While such devices have been fairly successful, they are somewhat limited in being able to control the rate of feed of the dampening fluid in extremely precise and accurately metered quantities. Further, operation of these devices requires a certain amount of skill in order to obtain the proper moisture balance for the particular requirements of the duplicating process. Thus devices of this kind are not simple and easy to use by clerical personnel, operating office-type duplicating machines, who are normally unskilled in the printing trade.

One of the steps normally required to assure adequate quality of the copies produced in this process is to properly time the turning on and turning off of the moisture system in accordance with the feeding of sheets through the duplicating machine. For example, it is essential to turn on the moisture system early enough so that the first sheet of a new run receives an adequate film of moisture. Providing the appropriate automatic controls to accomplish this without significant operator skill and judgment is accordingly an important purpose of this invention.

A moisture control apparatus providing for infinitely variable control and adjustment for precisely metering the rate of feed of the dampening fluid supplied to the master is disclosed in Carper and Morgan copending application Ser. No. 678,219, filed Apr. 19, 1976, now abandoned, assigned to the assignee of the present invention.

As disclosed therein, the apparatus comprises linkage means for converting continuous rotary input motion to incremental rotation of the fountain roller. The apparatus includes a drive link for imparting motion to the fountain roller and a control link for controlling the magnitude of incremental rotation, the drive and the control links being supported on independent pivots but both being swingable about a common adjustably positionable fixed pivot. The frequency of the incremental rotation of the fountain roller is proportional to the rotational speed of the duplicator, and the magnitude of the individual roller incremental rotational motions is substantially proportional to an angle formed between the drive and control links as determined by the position of the fixed pivot which is selectively settable to an infinitely variable position.

The foregoing device provides a highly successful arrangement for controlling the rate of feed of the dampening fluid in extremely precise and accurately metered quantities. It also provides a device which is simple and easy to use by machine operators who are relatively unskilled in the printing trade.

Another moisture control apparatus providing the advantages of the foregoing device and, additionally, providing control apparatus for maintaining the moisture roller train at a low level when copy sheets are not being fed and the machine is idling, is disclosed in Nothmann copending application Ser. No. 710,401, filed Aug. 2, 1976, also assigned to the assignee of the present invention.

As disclosed in this latter application, the apparatus comprises a link and a selectively settable drive arm supported on the axis of the fountain roller. The link is swingable into and out of abutting engagement with the drive arm for imparting motion to the drive arm and incremental rotation to the fountain roller defining a first mode of operation which obtains while printing is in progress. Trip means is provided for establishing a second mode of operation, in response to non-feeding of a copy sheet, in which the magnitude of the incremental rotations of the fountain roller are reduced from that obtaining during the first mode to maintain the rate of feed of the dampening fluid at a low level when the machine is idling and sheets are not being fed, and for restoring operation of the fountain roller from the second to the first mode in response to a sheet being fed.

The foregoing apparatus also provides a highly successful arrangement for controlling the rate of feed of the dampening fluid in extremely precise and accurately metered quantities and one which is simple and easy to use by machine operators who are relatively unskilled in the printing trade. It also provides a device for maintaining the moisture roller train at a low level to prevent an improper ink-moisture balance resulting from drying-out or excessive wetting of the roller train while the duplicator is operating but sheets are not being fed.

SUMMARY OF THE INVENTION

The apparatus of the present invention comprises linkage means for converting continuous rotary input motion to incremental rotation of the fountain roller, including an operator link for imparting swinging motion to a drive arm which in turn imparts incremental rotation to the fountain roller, and a control link for controlling the magnitude of incremental rotation. The drive arm and the control link are supported on independent pivots but both are swingable about a common adjustably positionable fixed pivot.

The frequency of the incremental rotation of the fountain roller is proportional to the rotational speed of the duplicator, and the magnitude of the individual roller incremental rotational motions is substantially proportional to an angle formed between the drive arm and the control link as determined by the position of the fixed pivot which is selectively settable to an infinitely variable position defining a first mode of operation. The infinitely variable setting of the fixed pivot provides substantial latitude in the ability to accurately meter the rate of feed of the dampening fluid to correspond to the requirements of the duplicating process.

The apparatus also includes trip means, operable in response to non-feeding of a copy sheet, for reducing the magnitude of the fountain roller incremental rotation from the first mode of operation to a second mode to maintain the rate of feed of the dampening fluid at a low level while the machine is idling, i.e., operating without feeding sheets. The trip means comprises an actuator link operable from a first to a second position for moving the fixed pivot from a position suited to the first mode of operation to one suited to the second mode of operation, whereby the operator link imparts motion to the drive arm of a magnitude significantly reduced from the motion imparted in the first mode, and the fountain roller is moved in increments of predetermined and reduced magnitude. The actuator link is restored from the second to the first position and the drive arm is restored from the second to the first mode of operaton in response to feeding of a copy sheet and resumption of the printing operaton.

Other features and advantages of the invention will appear hereinafter as the description proceeds.

IN THE DRAWING

DESCRIPTION OF THE PREFERRED EMBODIMENT

Figure 1:
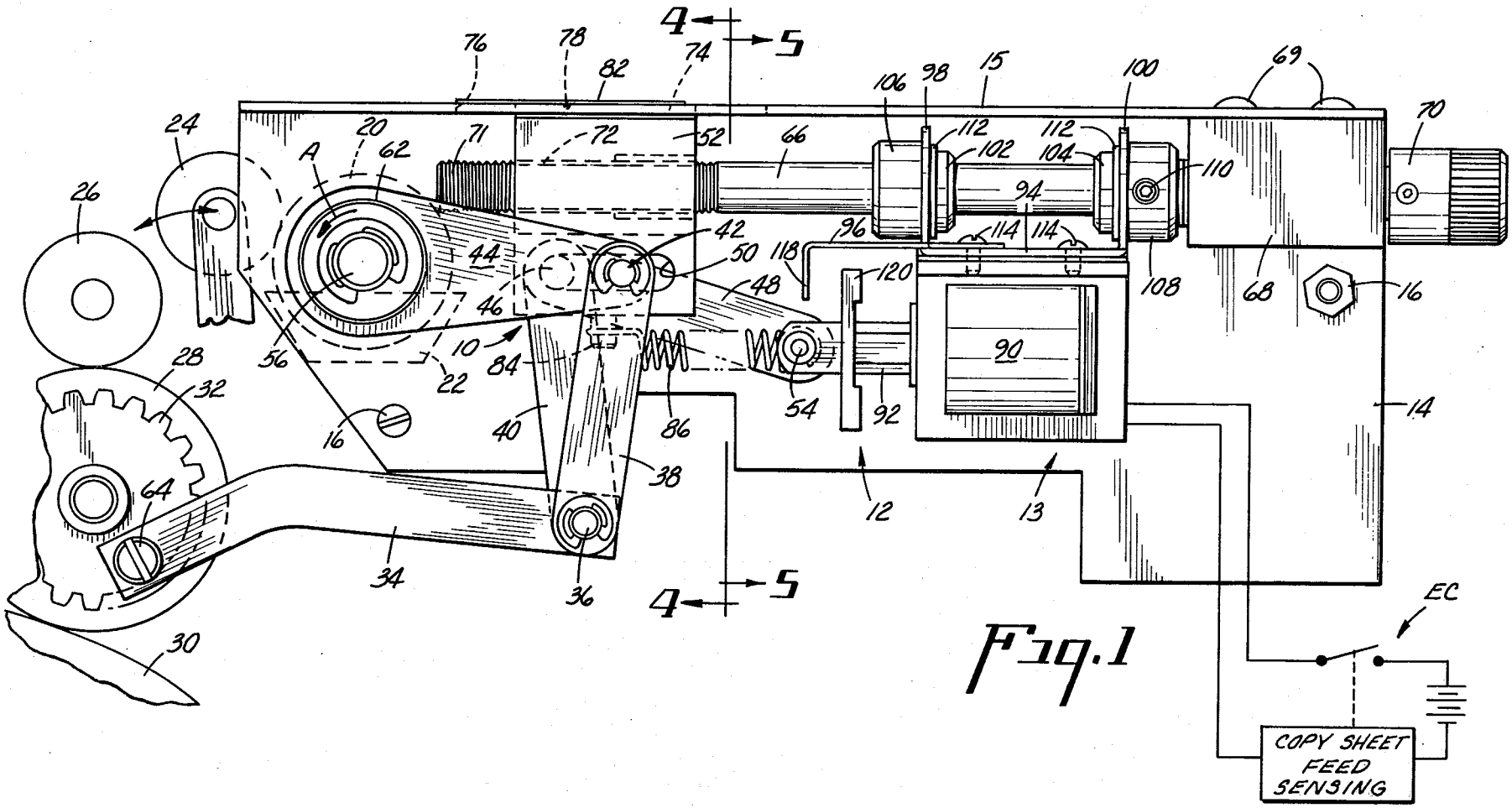
FIG. 1 is a front elevation of a moisture metering control apparatus in accordance with the present invention showing the apparatus in a first mode of operation during feeding and duplicating of copy sheets, and a circuit for conrolling operation of the solenoid.
Figures 2, 3, 4, 5:
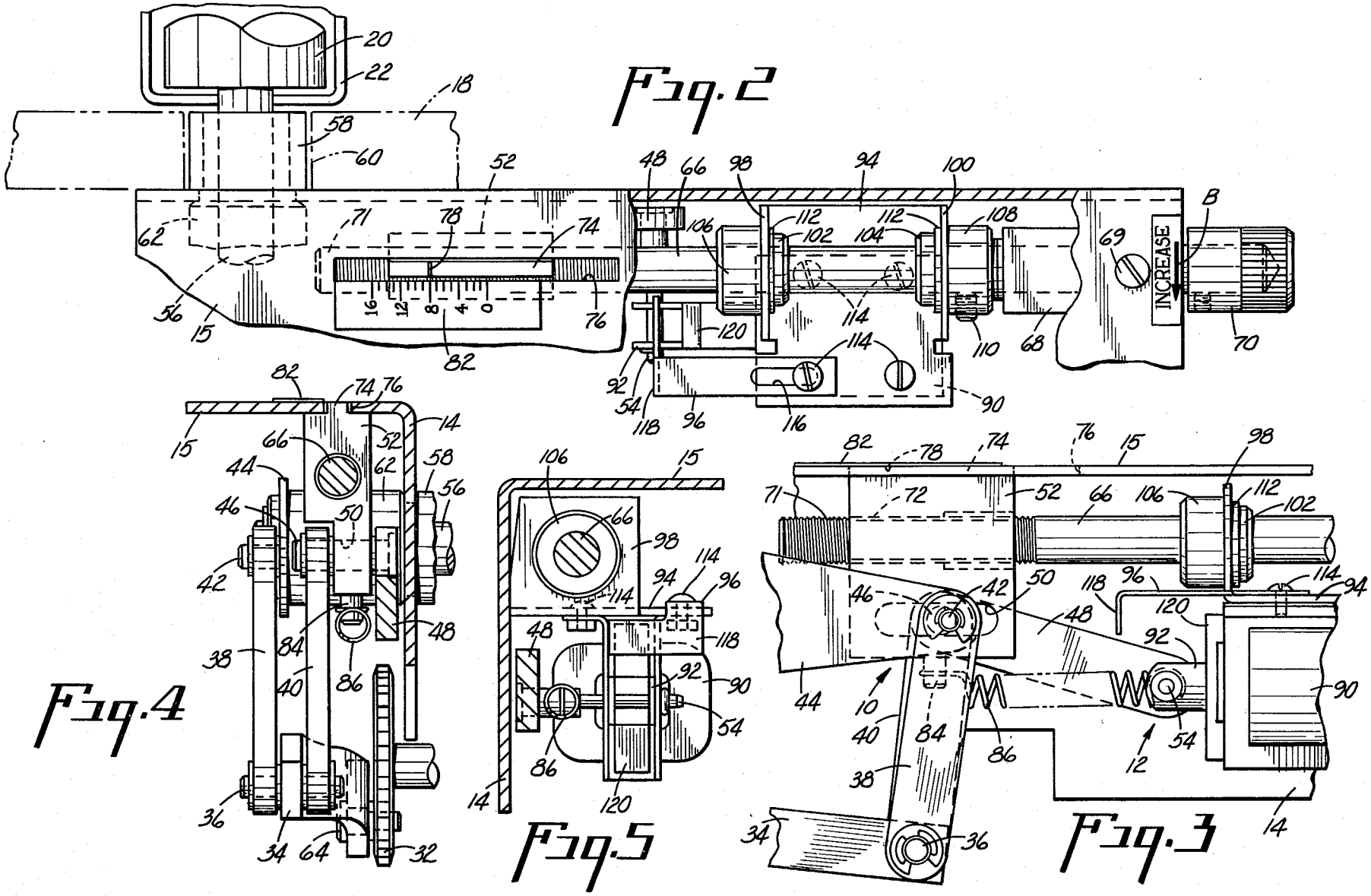
FIG. 2 is a plan view, partially broken away, of the apparatus of FIG. 1.
FIG. 3 is a partial front elevation similar to portions of FIG. 1, showing the apparatus in a second mode of operation during non-feeding of copy sheets while the machine is idling.
FIG. 4 is a section taken on the line 4—4 in FIG. 1.
FIG. 5 is a section taken on the line 5—5 in FIG. 1.

As shown in FIGS. 1 and 3, a control and a trip means are indicated generally by the reference numerals 10 and 12 respectively, and are mounted on a plate 13, comprising a side wall 14 and a top wall 15, secured by fastening means 16 to one of a pair of side plates of the duplicating machine, said one side plate being shown in phantom and indicated at 18 in FIG. 2. A fountain roller 20 is rotatably supported in the side plates and is adapted to be rotated intermittently to transfer dampening fluid from a fountain 22 to a ductor roller 24. The ductor roller 24 transfers the dampening fluid to a distributor roller 26 in contact with a form roller 28 which applies the dampening fluid to a master on a master cylinder 30.

The control means 10 also comprises a rotary drive element such as a gear 32 driven from the machine drive for imparting reciprocating motion to an operator link 34 provided with a pin 36 for connection with one end of a drive link 38 and one end of a control link 40. The other end of the drive link 38 is supported on a pivot pin 42 provided in an actuating arm 44, and the other end of the control link 40 is supported for swinging motion about a fixed pivot 46 at one end of an actuator link 48. The fixed pivot 46 extends through a slot 50 provided in an adjusting member 52 such that the control link 40 is positioned at one side of the adjusting member 52 (the front side as viewed in FIG. 1) and the actuator link 48 is positioned at the opposite or back side of the adjusting member 52 as shown in FIG. 3. The other end of the actuator link 48 is provided with a pin 54 for connecting the actuator link 48 to a plunger 92 of a solenoid 90 as will be further explained hereinafter. The actuating arm 44 is mounted on a shaft 56 of the fountain roller 20 for one-way driving connection therewith.

As shown in FIG. 2, an end of the shaft 56 extends outwardly beyong the side plate 18. A hub 58 is provided integral with the side wall 14 of the plate 13 and is positioned within a suitable opening 60 in the side plate 18. The hub 58 houses suitable bearing means for rotatably supporting the shaft 56 of the fountain roller 20.

The actuating arm 44 is provided with a hub 62 (FIG. 4) integral therewith and hub 62 houses suitable bearing means for supporting the actuating arm 44 on the shaft 56 of the fountain roller 20. Further, the hub 62 also houses a one-way roller clutch to permit unidirectional rotation of the fountain roller 20, and the hub 58, in addition to providing a bearing for the shaft, houses a one-way roller brake to prevent retrograde movement of the fountain roller 20 subsequent to each incremental rotation of the fountain roller in the direction of arrow A as shown in FIG. 1.

The operator link 34 is pivotally supported on a shoulder screw 64 which secures the operator link 34 to the drive gear 32, as shown in FIG. 1. The drive gear 32 is adapted to be driven continuously as long as the master cylinder 30 is being rotated, and is driven at a speed having a predetermined relationship to the speed of the master cylinder. Thus the fountain roller 20, for any given adjustment of the moisture metering control, is moved with an overall rotational effect proportional to the rotation speed of the master cylinder 30 whatever the speed setting of the duplicating machine. The rotary motion of the drive gear 32 imparts reciprocating motion to the operator link 34 which imparts swinging motion to the drive link 38 about the pivot pin 42. This motion is converted to oscillating motion of the actuating arm 44 for incrementally rotating the fountain roller 20 in increments of selectively variable magnitude.

The fountain roller 20 and the moisture roller train are so arranged that the ductor roller 24 ducts between the fountain roller and the distributor roller 26 approximately three times in each revolution of the master cylinder 30. The duration of contact of the ductor roller 24 with the fountain roller 20 provides, as a minimum, for the ductor roller to remain in contact with the fountain roller at least during the period that the fountain roller is being moved through its individual incremental motions.

As shown in FIG. 4, the drive link 38 and the control link 40 straddle the operator link 34 and the actuating arm 44, and are independently supported at their upper ends for swinging motion about the pivot pin 42 and the fixed pivot 46 respectively, in response to reciprocating motion of the operator link 34. The drive link 38 and the control link 40 form a link system and, although not rigidly connected to each other, move as a unit when driven by the operator link 34. Through movement of the adjusting member 52, which will be described hereinafter, the fixed pivot 46 is positionable between a neutral position in which it is coaxial with the pivot pin 42, and any of various desired selected set positions defining a first mode of operation in which the fixed pivot 46 has its axis spaced laterally from the axis of the pivot pin 42, accordingly changing the configuration of the link system 38, 40 by increasing or decreasing the fixed angle between the links 38 and 40.

Thus, with the fixed pivot 46 in the neutral position there is provided a common axis 42, 46 for swinging movement of the link system. In this position the reciprocating motion of the operator link 34 merely swings the link system to and fro and is ineffective to oscillate the actuating arm 44 to impart incremental motion to the fountain roller 20. However, as the fixed pivot 46 is moved out of alignment with the pivot pin 42, thereby depriving the link system of the common axis, the link system then swings about the fixed pivot 46 causing the end of the drive link 38 supported on the pivot pin 42 to travel in an arcuate path about the axis of the fountain roller 20 under constraint of the actuating arm 44.

The degree of travel of the drive link 38 on the arcuate path is determined by the degree of angular separation between the pivot pin 42 and the fixed pivot 46 in relation to the movement of the operator link 34. This degree of travel controls the magnitude of the individual fountain roller incremental motions to any desired value within a normally functional range by infinitiesimal degrees.

In FIGS. 1 and 2 is shown means for moving the adjusting member 52 for setting the control means 10 and, specifically, the fixed pivot 46 and the control link 40 to a selected position for obtaining a desired magnitude of incremental motion of the fountain roller 20, and hence an accurate and uniform metered rate of feed of the dampening fluid during operation in the first mode while copy sheets are being fed and duplicated. This means comprises selector means including an adjusting rod 66, a block 68 secured by screws 69 to the underside of the top wall 15 of the plate 13 and a knob 70 for manually rotating the adjusting rod 66. The knob 70 is secured to one end of the adjusting rod 66 and the other end of the adjusting rod is provided with threads 71 in threaded engagement with a tapped hole 72 in the adjusting member 52.

As shown in FIGS. 1, 2 and 4, the adjusting member 52 is provided with a rib 74 projecting upwardly through an elongate slot 76 provided in the top wall 15 of the plate 13, thereby guiding its motion and preventing rotation about the screw axis. The rib 74 is provided with an indicator mark 78 for positioning the adjusting member 52 at a selected position relative to a graduated scale 82 affixed to the outer face of the top wall 15 and in alignment with an edge of the elongate slot 76. Further, the adjusting member 52 is provided with a pin 84 depending therefrom for retaining one end of a spring 86, the other end of the spring being connected to the pin 54 to thereby bias the actuator link 48 to the left, as viewed in FIGS. 1 and 3, and maintain the fixed pivot 46 against the left end of the slot 50 formed in the adjusting member 52 for a purpose which will presently appear.

As shown in FIGS. 1 and 2, the knob 70 is adapted to be rotated in either direction for rotating the adjusting rod 66 and, through the threaded engagement of the adjusting rod with the adjusting member 52, for moving the adjusting member 52 leftwardly or rightwardly as viewed in FIGS. 1, 2 and 3. Thus, rotation of the adjusting knob 70 in a counterclockwise direction, as shown by the arrow B in FIG. 2, is effective to move the adjusting member 52 towards the left, thereby positioning the fixed pivot 46 a further distance from the pivot pin 42 and increasing the angle between the links 38 and 40 so as to increase the magnitude of the individual fountain roller incremental motions and the rate of feed of the dampening fluid supplied to the master.

Conversely, in response to rotating the knob 70 in a clockwise direction, the adjusting member 52 is moved towards the right as viewed in FIGS. 1, 2 and 3, thereby positioning the fixed pivot 46 closer to the pivot pin 42 and decreasing the angle between the links 38 and 40 and reducing the rate of feed of the dampening fluid. In this connection it should be noted that the fixed pivot 46 is normally maintained against the left end of the slot 50 by the action of the spring 86 working through the agency of the actuator link 48 so that there is no sliding movement of the fixed pivot 46 with respect to the adjusting member 52. To aid the machine operatcr in setting the apparatus to a desired selected position, the top wall 15 is provided with the arrow B indicating the direction of rotation of the knob 70 for increasing the rate of feed of the fluid, and the indicator mark 78 provides for micrometer setting of the adjusting member 52 relative to the graduated scale 82.

The trip means 12 for establishing a second mode of operation, for reducing the rate of feed of the dampening fluid supplied to the moisture roller train when the machine is idling and copy sheets are not being fed, comprises an actuator means including the solenoid 90 and plunger 92 mounted on a generally U-shaped mounting bracket 94 provided with an adjustable stop member 96 as shown in FIGS. 1, 2 and 3. The mounting bracket 94 includes a pair of upwardly projecting legs 98 and 100 each provided with a clearance hole for receiving for free rotation therein a shoulder 102 of a bushing 106 and a shoulder 104 of a bushing 108. The bushings 106 and 108 are mounted on the adjusting rod 66 and support the mounting bracket 94 for movement axially on the adjusting rod 66 for selectively positioning the solenoid 90 whereby to adjust the pulled-in or activated position of the solenoid plunger 92. One of the bushings such as 108 is retained on the adjusting rod 66 by a set screw 110 for holding the solenoid 90 in the set position, and each bushing is held in place relative to its respective leg 98 and 100 by a retaining ring 112.

The solenoid 90 is secured to the mounting bracket 94 with screws 114 and depends therefrom. The plunger 92, as mentioned supra, is connected to the pin 54 which pivotally supports one end of the actuator link 48 and one end of the spring 86. The stop member 96 is also secured to the mounting bracket 94 with one of the screws 114 passing through an elongate slot 116 in the mounting bracket to permit movement of the stop member 96 for adjustment purposes, see FIGS. 1, 2 and 3. The stop member 96 is provided with a downwardly formed ear 118 which is positionable to a selected position relative to an abutment element 120 mounted on the plunger 92. In this way, the ear 118 can be so set as to prevent the plunger 92 from ever being overextended and thereby failing to retract when the solenoid 90 is energized.

With reference to FIG. 1, when the solenoid 90 is in a de-energized state the plunger 92 is biased outwardly of the solenoid 90 by the spring 86 and the actuator link 48 is urged leftwardly to position the fixed pivot 46 in a normal position. As shown in FIG. 1, the solenoid 90 is in an electrical circuit EC which provides that it can be energized by means for detecting the absence of a copy sheet at a predetermined point in the sheet path of the machine, and de-energized by means for detecting the presence of a copy sheet. While copy sheets are being fed and duplicated, the solenoid 90 is in a deenergized state and the control means 10 is in the first mode of operation as shown in FIG. 1, whereby the rate of feed of the dampening fluid supplied to the master on the master cylinder is metered in accordance with the setting of the fixed pivot 46 by the adjusting member 52 through the selector means.

However, in response to detection of the absence of a copy sheet in the sheet path, indicating an interruption in the duplicating operation, a signal is generated to energize the solenoid 90 thereby drawing the plunger 92 inwardly and moving the actuator link 48 rightwardly, against the bias of the spring 86, to position the fixed pivot 46 from the normal position shown in FIG. 1 to a low moisture position shown in FIG. 3. This movement of the plunger 92 causes the control link 40 to pivot in a clockwise direction as viewed in FIG. 3, thereby moving the fixed pivot 46 to the right and away from the left end of the slot 50 of the adjusting member 52. The right-hand limit of the movement of the fixed pivot 46 in the slot 50 is adjustably settable by selectively positioning the solenoid 90, as described above, towards or away from the adjusting member 52 by moving the mounting bracket 94 along the adjusting rod 66 and, when set at the desired position, securing the mounting bracket 94 in place by tightening the set screw 110 against the adjusting rod 66. This setting of the solenoid 90 determines the rightmost terminal position of the plunger 92 as viewed in FIG. 1 in response to energization of the solenoid 90 which overcomes the bias of the spring 86, and hence determines the low moisture position of the fixed pivot 46.

Because the fixed pivot 46 is now positioned closer to the pivot pin 42 than when the control means 10 is in the first mode, the magnitude of travel imparted to the drive link 38 on the arcuate path, through the swinging motion of the link system by the operator link 34, is greatly decreased from the magnitude of travel of the drive link 38 when operating in the first mode, and the rate of feed of the dampening fluid to the moisture roller train is reduced.

By virtue of this construction, the position of the solenoid can be so set as to give any particular desired low value of dampening fluid supply to the moisture roller train during solenoid energization, and when a proper setting is achieved, it normally requires changing only very rarely.

The operation of the machine under low moisture conditions continues while the machine is idling and until such time as a copy sheet is again fed and detected in the sheet path. In response thereto, the solenoid 90 is de-energized causing the plunger 92 to be extended by the spring 86, the actuator link 48 is moved towards the left to position the fixed pivot 46 to the normal position against the left end of the slot 50 as shown in FIG. 1 for operation of the control means 10 in the first mode. Thus, the control means is actuated between the first and the second mode of operation solely in response to the presence and absence of a copy sheet in the sheet path respectively, and does not require any intervention on the part of the machine operator.

It will be appreciated that the present invention provides a control means adjustable to a selected position within a wide range of positions, for operation in the first mode, such that the incremental rotation imparted to the fountain roller may be set with micrometer accuracy. Also, the trip means provides for conditioning the control means for operation in the second mode for supplying a reduced amount of dampening fluid, by reducing the magnitude of the individual incremental motions of the fountain roller, in response to non-feed of copy sheets to maintain the moisture roller train at a low moisture level while the machine is idling. The trip means provides for restoring the control means from the second to the first mode of operation in response to detection of a copy sheet fed into the sheet path, and both the first and the second mode operations are effected without machine operator intervention.

Further, the apparatus is simple in construction and use whereby operators relatively unskilled in the printing trade can quickly and easily set the proper moisture balance for obtaining high quality duplicated copies, especially in those applications wherein the duplicating machine is equipped with a non-molleton moisture roller system, and without concern of excessive wetting or drying-out of the moisture roller train during machine idling.

What is claimed is:

1. A lithographic duplicating machine comprising:

a master cylinder;

fountain means including a fountain roller for supplying dampening fluid to a master on the master cylinder;

a drive element; and a control means for metering the rate of feed of the fluid, comprising:

an actuating arm mechanically associated with the fountain roller for rotating the same unidirectionally;

linkage means for oscillating the actuating arm and rotating the fountain roller in intermittent increments, said linkage means comprising:

a first link supported for swinging movement about a pivot means associated with the actuating arm;

a second link pivotably connected with the first link and supported for swinging movement about a fixed pivot;

an operating means for imparting swinging movement to the first and second links as a unit about the fixed pivot in response to movement of the drive element;

means for adjusting the linkage means with respect to its operation in a first mode including means to adjust the position of the fixed pivot to a selected normal position to set the magnitude of the incremental motions of the fountain roller to a desired value by infinitesimal degrees to control the feed of dampening fluid during a printing operation; and means for moving the fixed pivot, independently of the setting of the adjusting means, between the selected normal position as determined by the adjusting means, and a low-moisture position closer to the axis of the pivot means, providing operation of the linkage means in a second mode in which the fountain roller is rotated in increments of less magnitude than those which characterize operation in the first mode.

2. A lithographic duplicating machine as set forth in claim 1 in which the means for moving the fixed pivot comprises:

biasing means for urging the fixed pivot to the normal position; and actuator means for moving the fixed pivot from the normal to the low-moisture position and for maintaining it thereat in opposition to the biasing means.

3. A lithographic duplicating machine as set forth in claim 2 in which the actuator means is operable for moving the fixed pivot from the normal to the low-moisture position in response to non-feeding of a copy sheet, and for moving the fixed pivot from the low-moisture to the normal position in response to feeding of a copy sheet to be printed.

4. A lithographic duplicating machine as set forth in claim 2 further comprising means for adjustably determining tjhe rate of fluid feed when the actuator means causes movement of the fixed pivot to low-moisture position.

5. A lithographic duplicating machine as set forth in claim 2 in which the actuator means comprises a solenoid.

6. A lithographic duplicating machine as set forth in claim 4 in which the actuator means comprises a solenoid, and in which the means for adjustably determining the rate of fluid feed related to low moisture position of the fixed pivot comprises means for fixing the solenoid in plural selected positions.

7. A lithographic duplicator as set forth in claim 1 futher comprising means for adjustably determining the rate of fluid feed when the fixed pivot is in low-moisture position.

8. For use with a lithographic duplicating machine comprising a master cylinder, fountain means including a fountain roller for supplying dampening fluid to a master on the master cylinder, and a drive element:

a control means for metering the rate of feed of the fluid, comprising:

an actuating arm mechanically connectable with the fountain roller for rotating the same unidirectionally;

linkage means for oscillating the actuating arm and rotating the fountain roller in intermittent increments, said linkage means comprising:

a first link supported for swinging movement about a pivot means associated with the actuating arm;

a second link pivotably connected with the first link and supported for swinging movement about a fixed pivot;

an operating means forl imparting swinging movement to the first and second links as a unit about the fixed pivot in response to movement of the drive element;

means for adjusting the linkage means with respect to its operation in a first mode including means to adjust the position of the fixed pivot to a selected normal position to set the magnitude of the incremental motions of the fountain roller to a desired value by infinitesimal degrees to control the feed of dampening fluid during a printing operation; and means for moving the fixed pivot, independently of the setting of the adjusting means, between the selected normal position as determined by the adjusting means, and a low-moisture position closer to the axis of the pivot means, providing operation of the linkage means in a second mode in which the fountain roller is rotated in increments of less magnitude than those which characterize operation in the first mode.

* * * * *